US009481840B2

(12) United States Patent
Smith, Jr. et al.

(10) Patent No.: US 9,481,840 B2
(45) Date of Patent: Nov. 1, 2016

(54) HYDROXYETHYLHYDRAZINIUM NITRATE-ACETONE FORMULATIONS AND METHODS OF MAKING HYDROXYETHYLHYDRAZINIUM NITRATE-ACETONE FORMULATIONS

(75) Inventors: James E. Smith, Jr., Huntsville, AL (US); Gregory E. Ogden, Tucson, AZ (US); Clinton J. Brown, Huntsville, AL (US); Paul M. Frisby, Huntsville, AL (US); Sahar A. Torabzadeh, Harvest, AL (US)

(73) Assignees: UNIVERSITY OF ALABAMA IN HUNTSVILLE, HSV, AL (US); OGDEN ENGINEERING & ASSOCIATES, LLC, Tucson, AZ (US)

( * ) Notice: Subject to any disclaimer, the term of this patent is extended or adjusted under 35 U.S.C. 154(b) by 1563 days.

(21) Appl. No.: 12/798,787

(22) Filed: Apr. 9, 2010

(65) Prior Publication Data

US 2010/0287824 A1 Nov. 18, 2010

Related U.S. Application Data

(60) Provisional application No. 61/168,775, filed on Apr. 13, 2009.

(51) Int. Cl.

| | |
|---|---|
| ***C10L 1/24*** | (2006.01) |
| ***C10L 1/02*** | (2006.01) |
| ***C06B 47/00*** | (2006.01) |

(52) U.S. Cl.

CPC . *C10L 1/02* (2013.01); *C06B 47/00* (2013.01)

(58) Field of Classification Search

CPC ..... C10L 1/22; C10L 1/226
USPC ..... 44/416
See application file for complete search history.

(56) References Cited

U.S. PATENT DOCUMENTS 6,218,577 B1 * 4/2001 Brand et al. ..... 564/464
6,254,705 B1 * 7/2001 Anflo et al. ..... 149/1

* cited by examiner

*Primary Examiner* — Ellen McAvoy
*Assistant Examiner* — Ming Cheung Po
(74) *Attorney, Agent, or Firm* — Thomas Horstemeyer, LLP

(57) ABSTRACT

Embodiments of the present disclosure include one-step synthesis to prepare a hypergolic green Fuel (HGF) propellant from 2-Hydroxyethylhydrazine (HEH) via a "one-step synthesis method". In addition, embodiments of the present disclosure include fully nitrated HGF and partially nitrated HGF and formulations containing Hydroxyethylhydrazinium Nitrate (HEHN) and acetone, where the HEHN is produced independently.

18 Claims, 14 Drawing Sheets

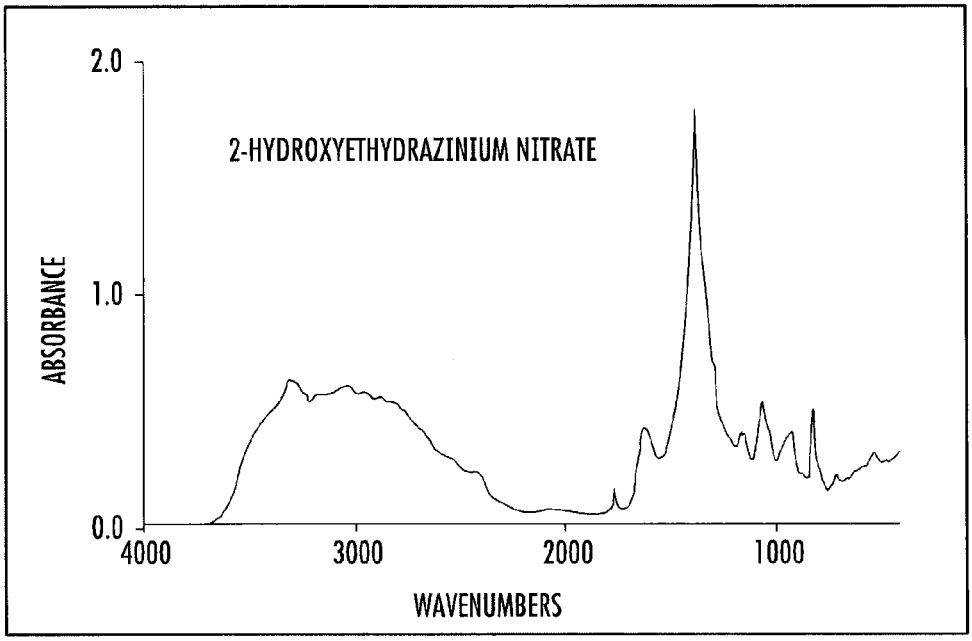
FIG. 1.1
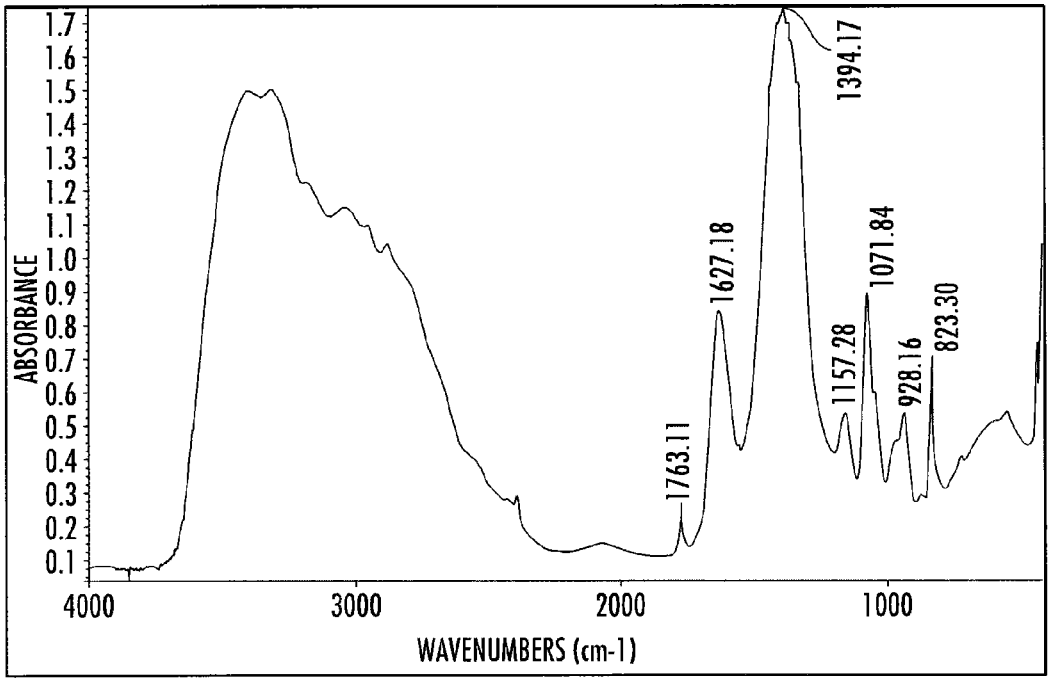
FIG. 1.2

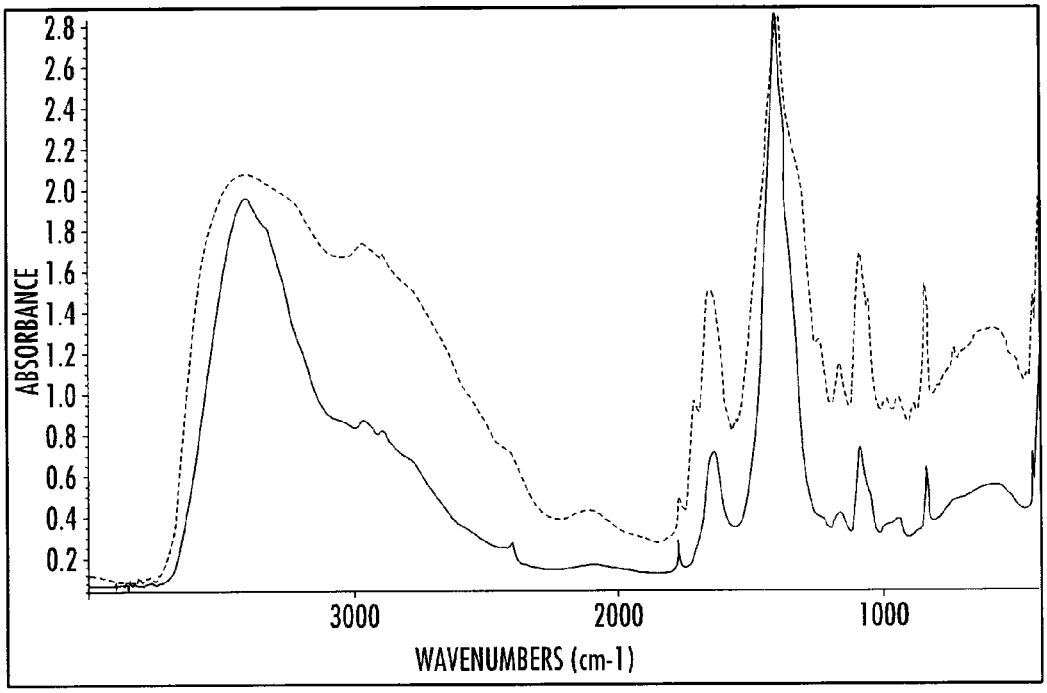
FIG. 1.3
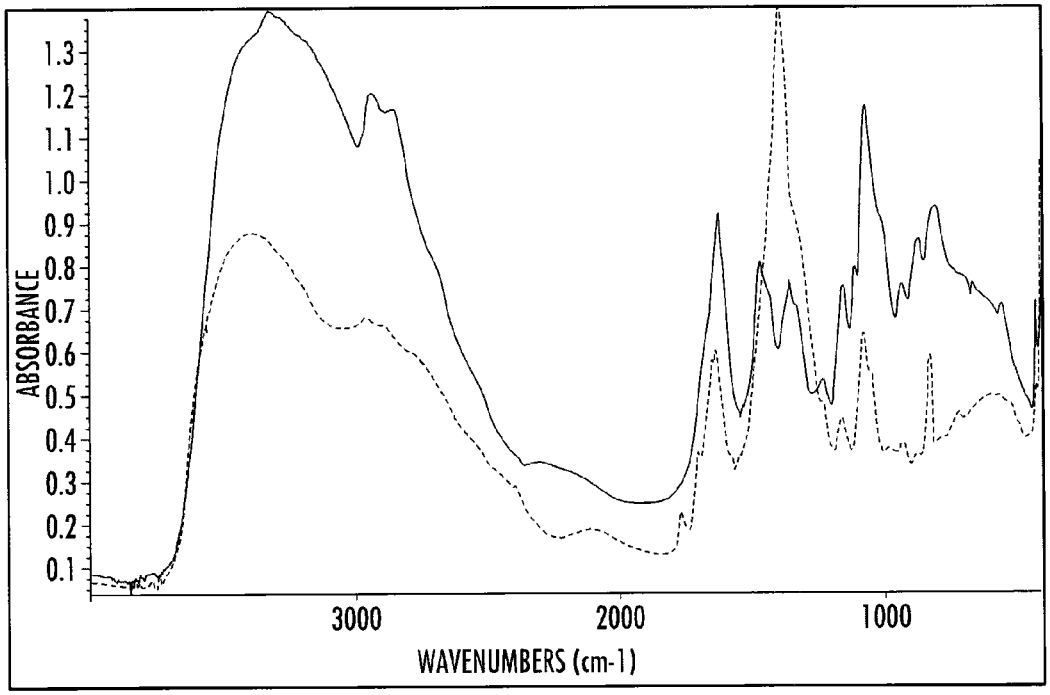
FIG. 1.4

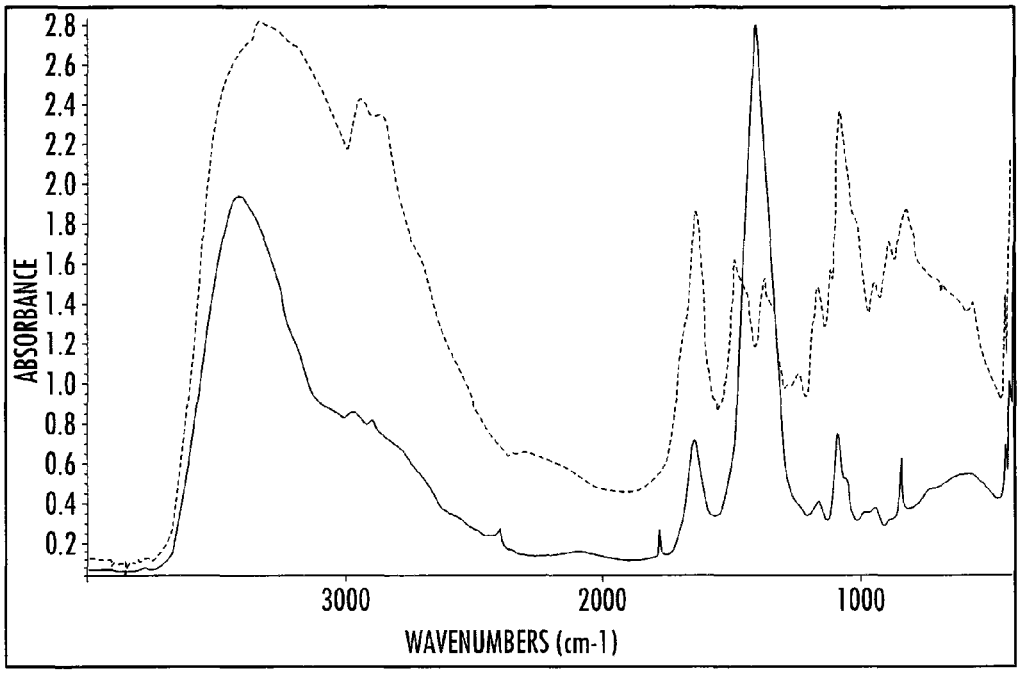
FIG. 1.5
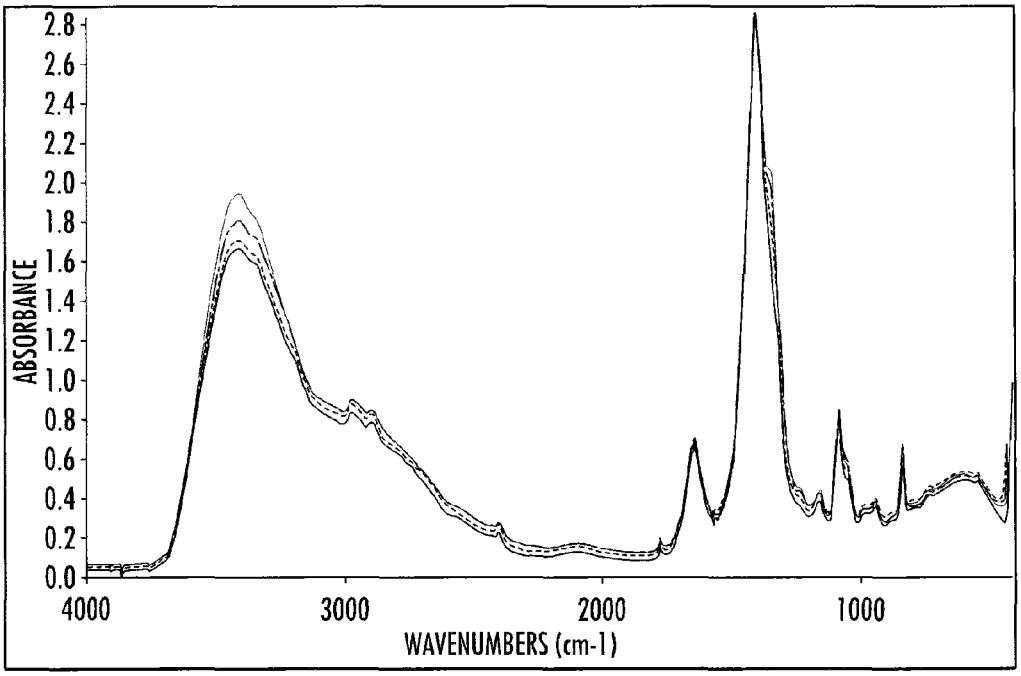
FIG. 1.6

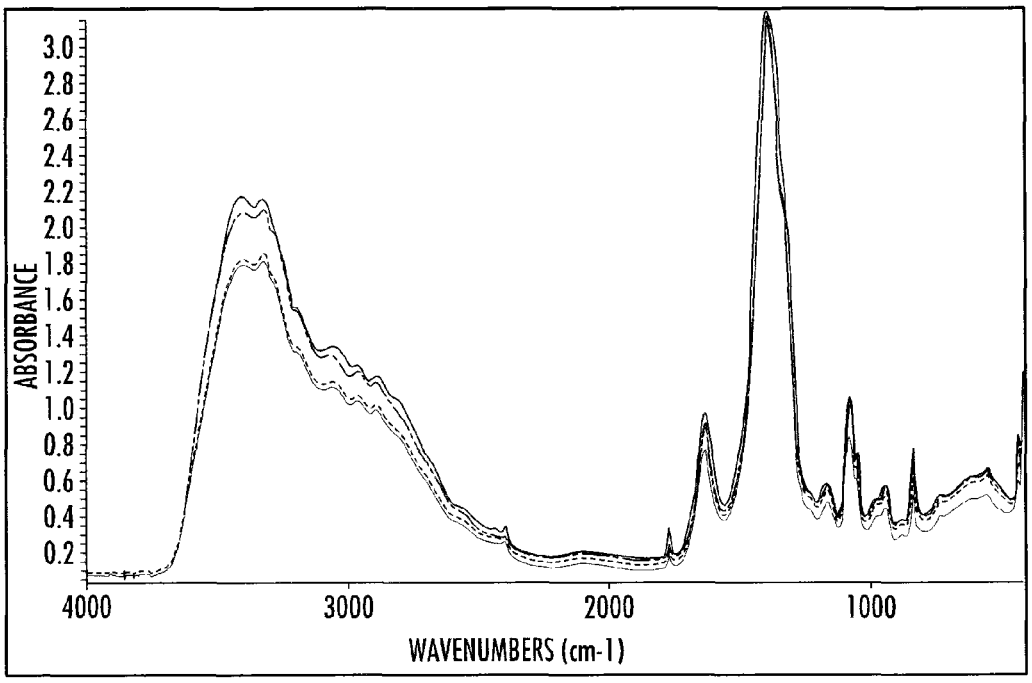
FIG. 1.7
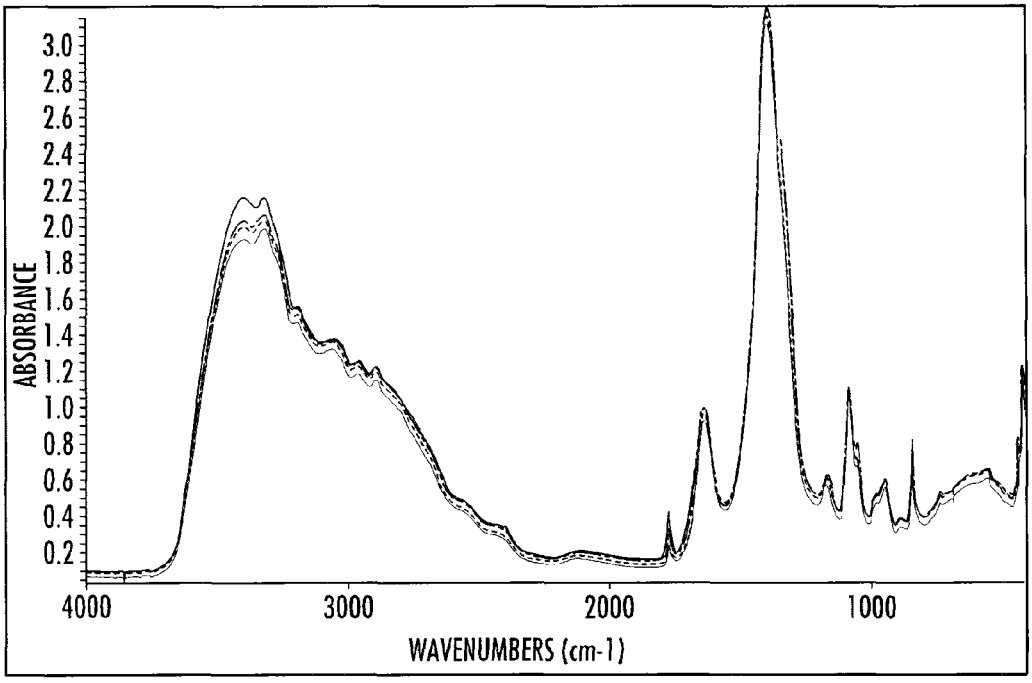
FIG. 1.8

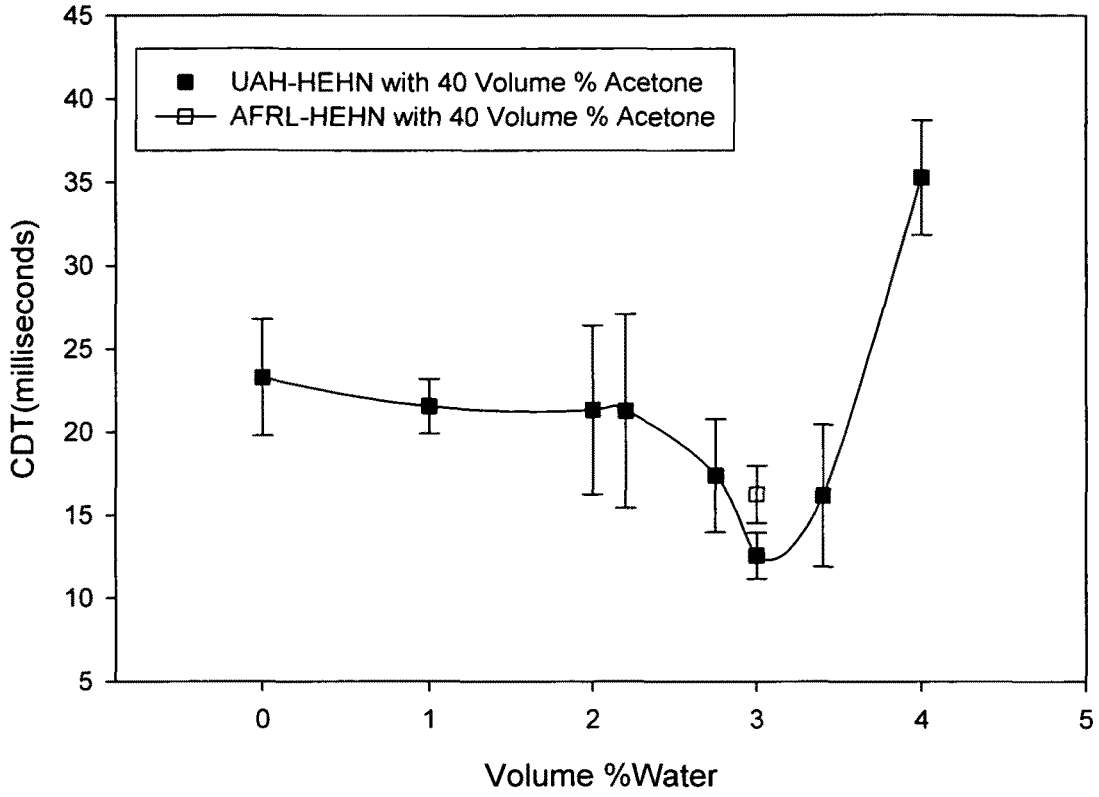
Figure 1.9

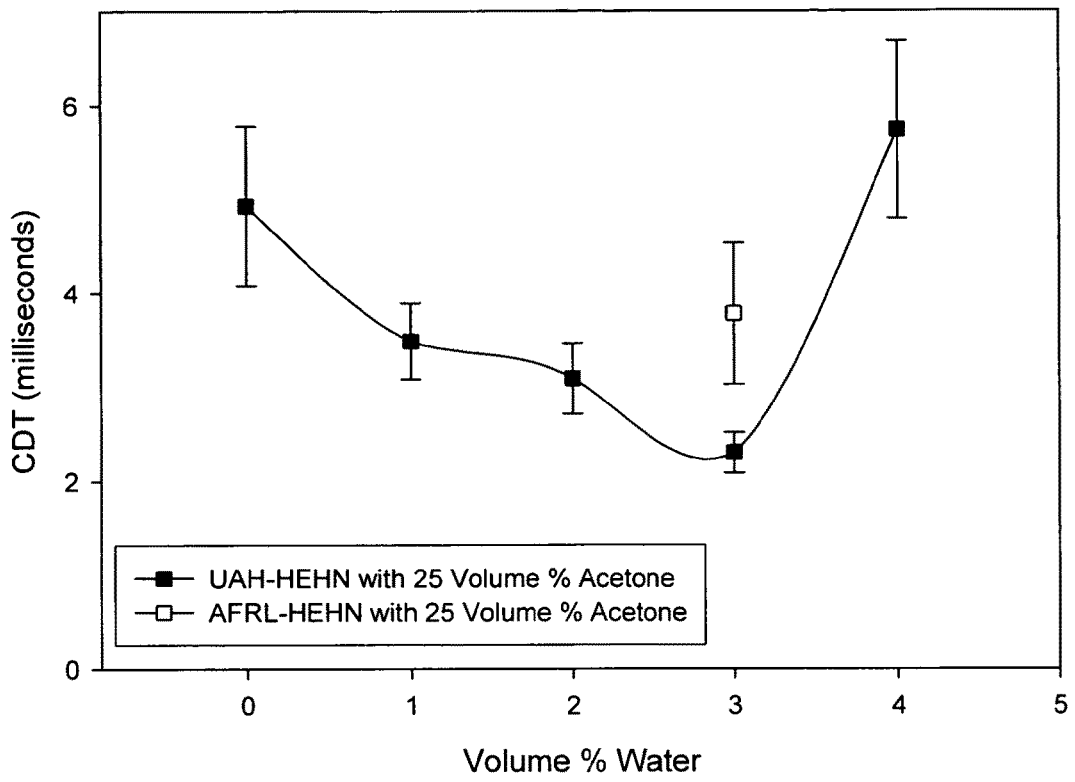
Figure 1.10

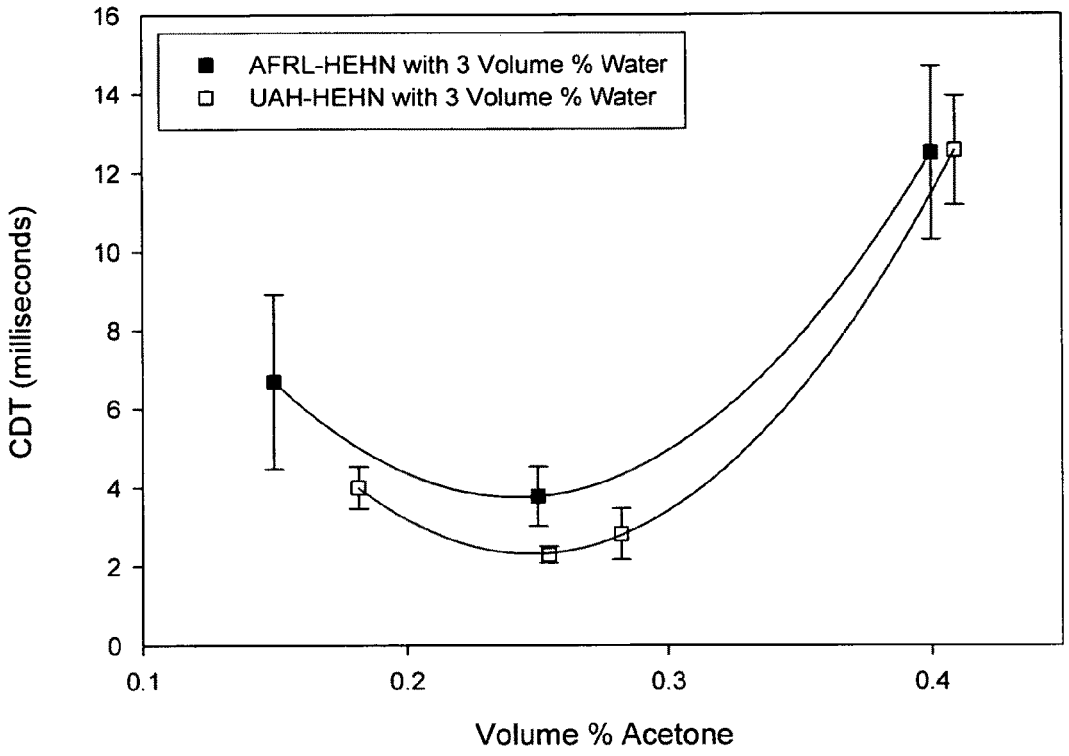
Figure 1.11

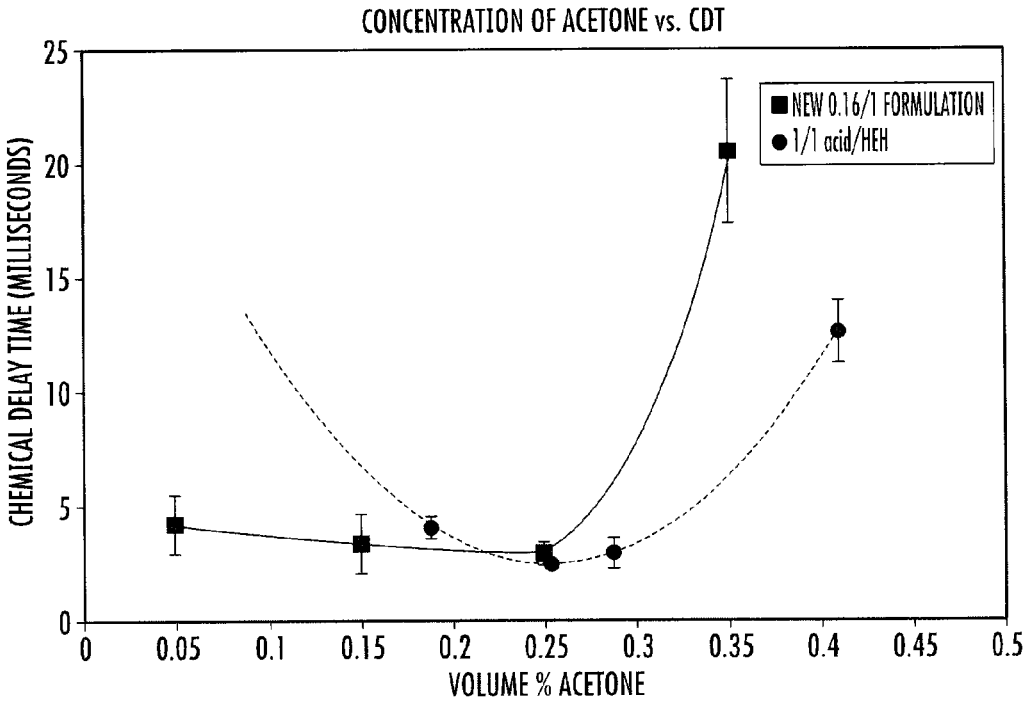
FIG. 1.12
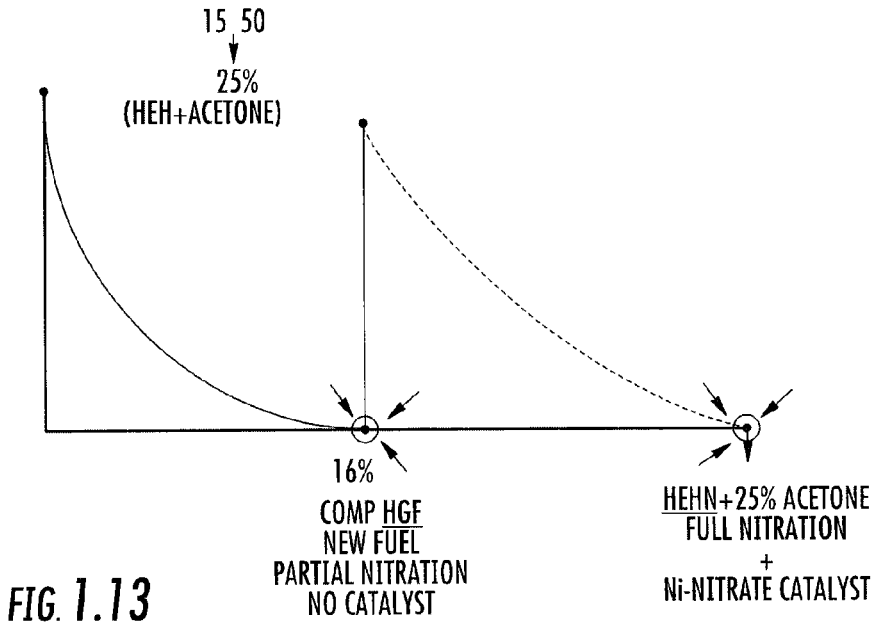
FIG. 1.13

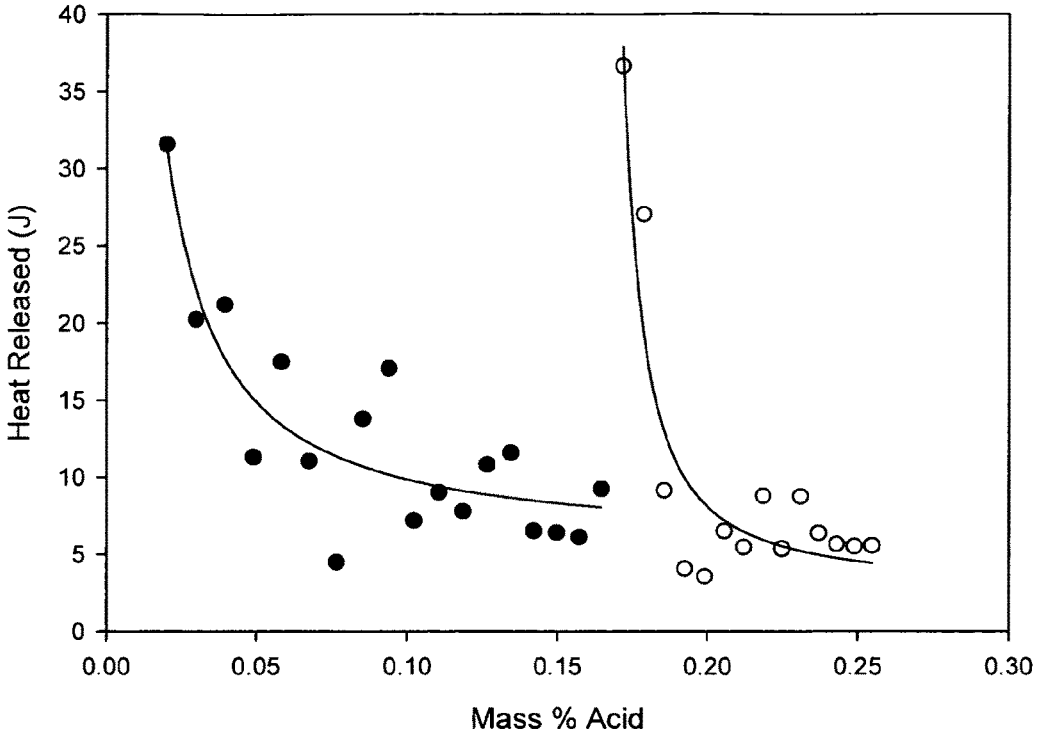
FIG. 2.1

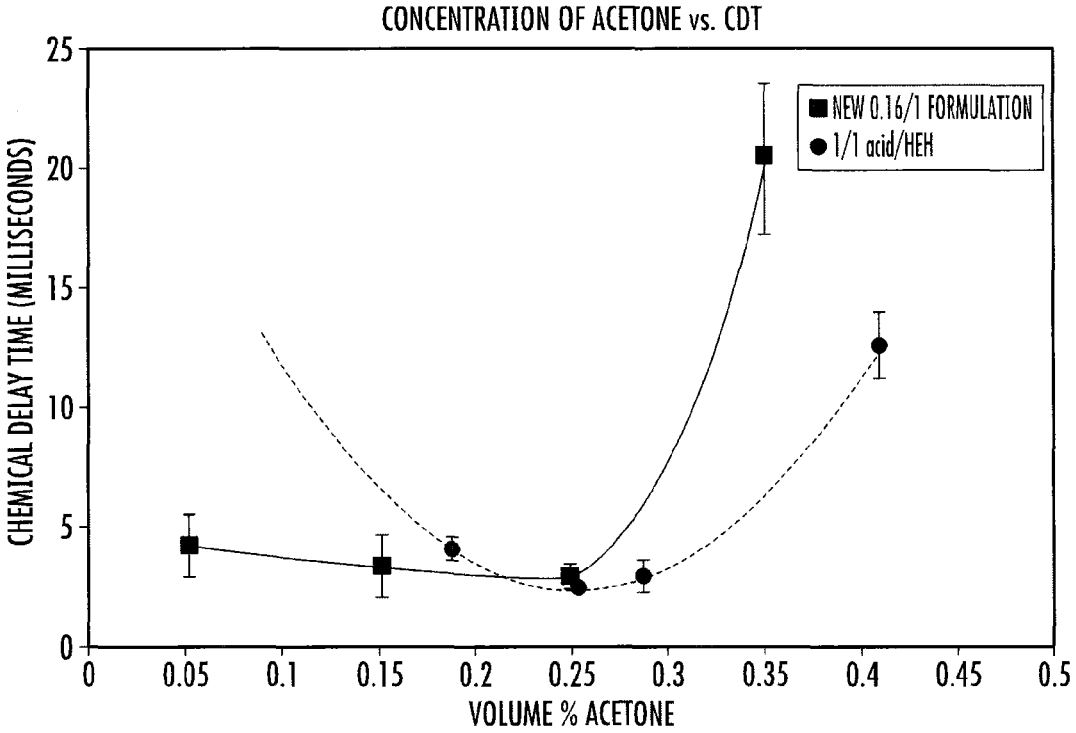
FIG. 3.1

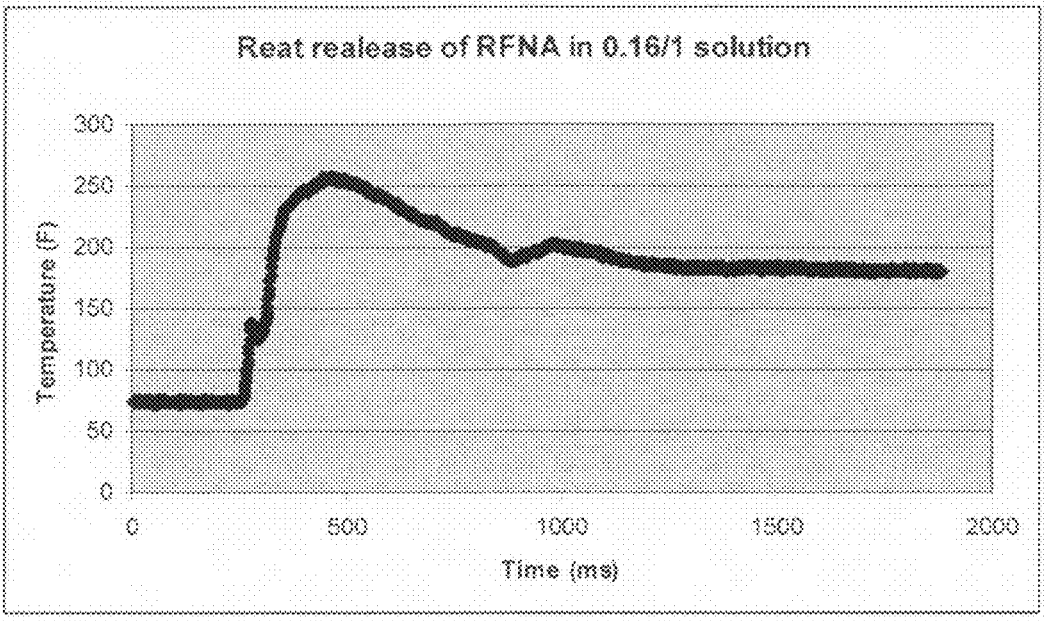
FIG. 3.2

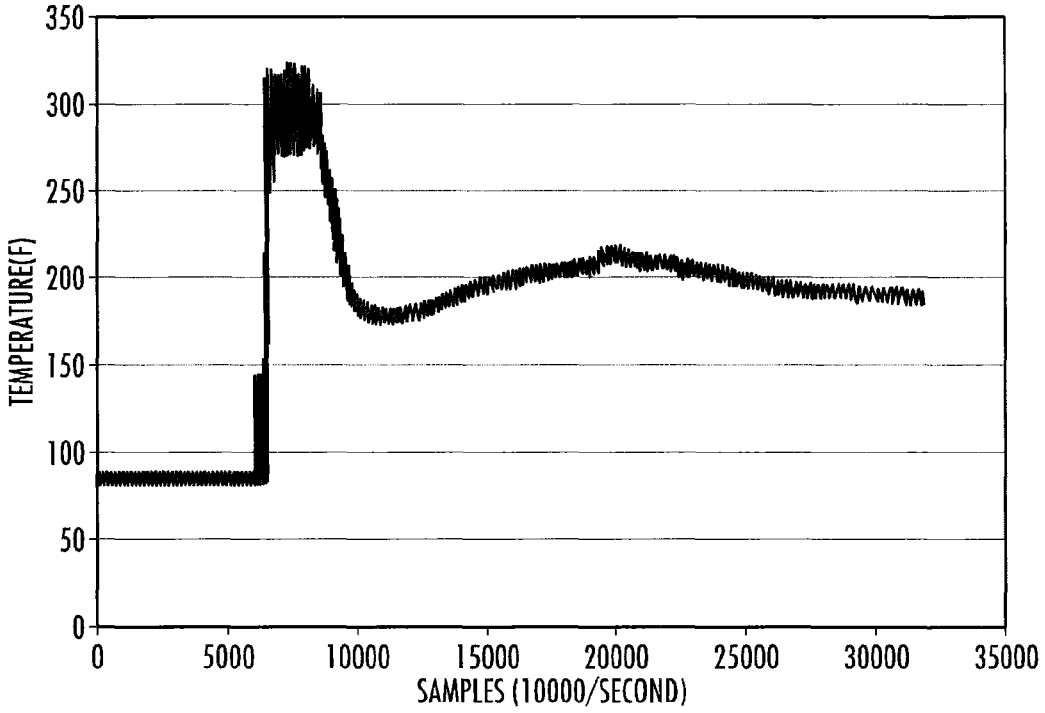
FIG. 4.1
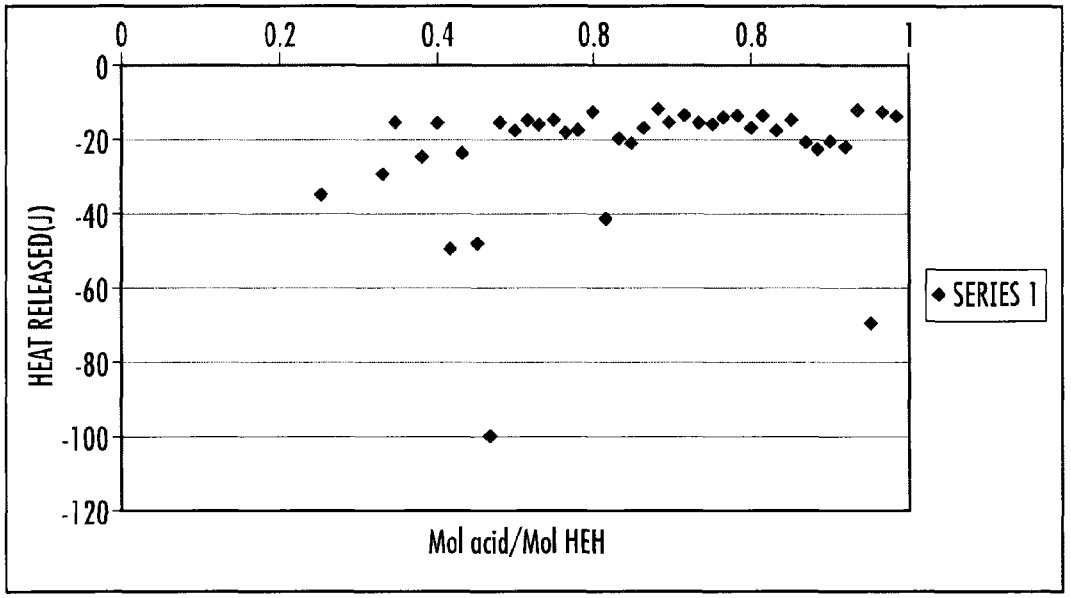
FIG. 4.2

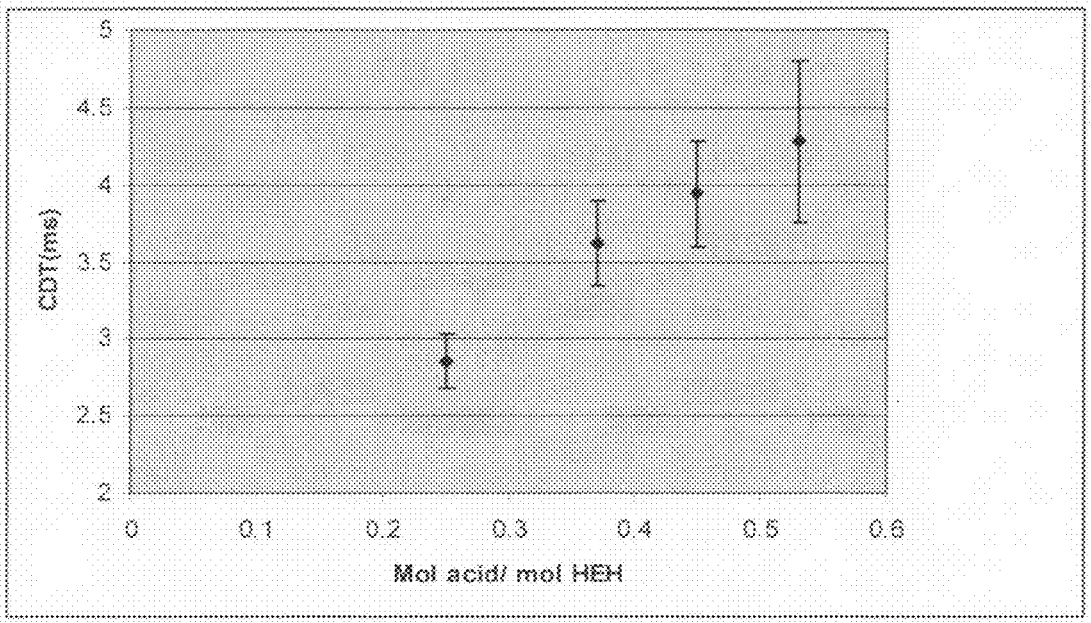
Figure 4.3: CDT of RFNA added to 0.16/1 solution
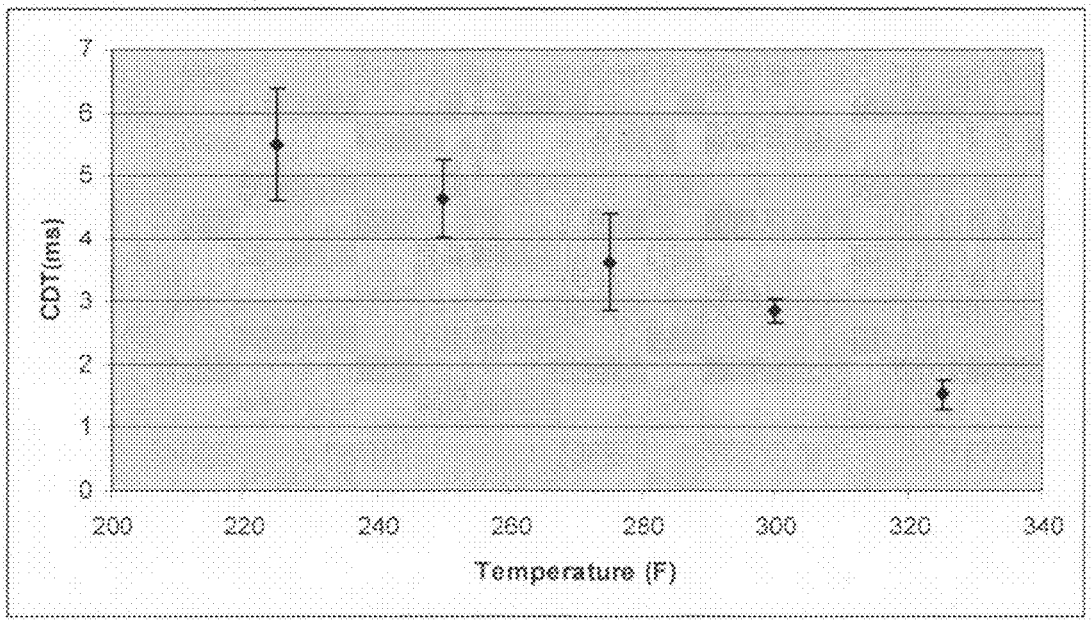
Figure 4.4: Temperature vs. CDT

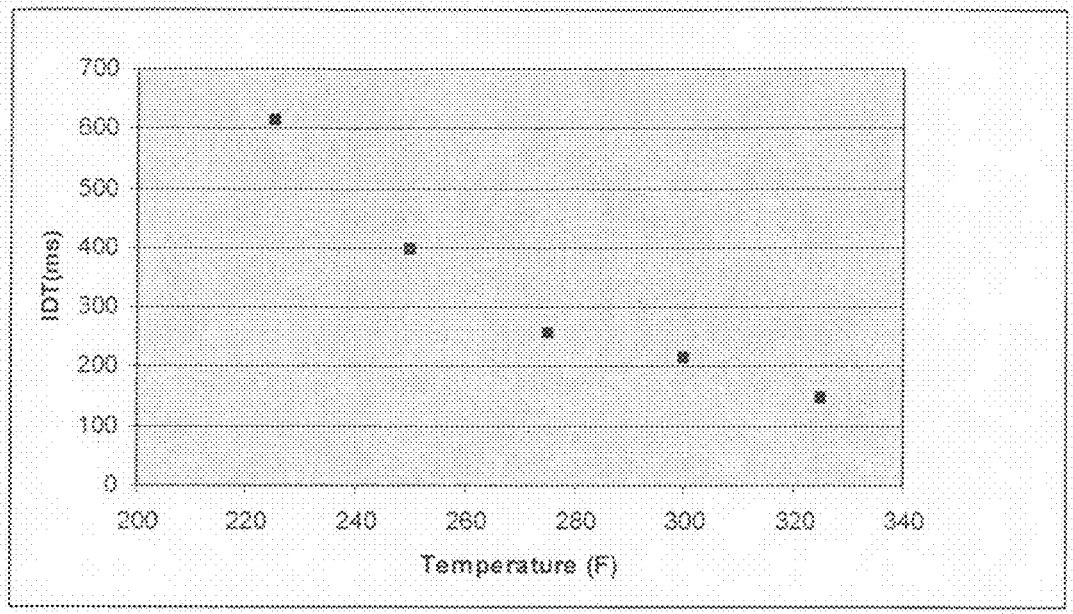
Figure 4.5: Temperature vs. IDT

HYDROXYETHYLHYDRAZINIUM NITRATE-ACETONE FORMULATIONS AND METHODS OF MAKING HYDROXYETHYLHYDRAZINIUM NITRATE-ACETONE FORMULATIONS

CROSS-REFERENCE TO RELATED APPLICATION

This application claims priority to U.S. provisional applications entitled, "HYDROXYETHYLHYDRAZINIUM NITRATE-ACETONE FORMULATIONS AND METHODS OF MAKING HYDROXYETHYLHYDRAZINIUM NITRATE-ACETONE FORMULATIONS," having Ser. No. 61/168,775 filed on Apr. 13, 2009, which is entirely incorporated herein by reference.

STATEMENT REGARDING FEDERALLY SPONSORED RESEARCH OR DEVELOPMENT

This invention was made with government support under Grants: as provided for by the terms of SBIR Phase II Contract No. W9113M-06-00179 awarded to Ogden Engineering & Associates, LLC (OE&A) by the Space and Missile Defense Command (SMDC) for the US Missile Defense Agency (MDA). The government has certain rights in the invention.

BACKGROUND

The Air Force Research Laboratory (AFRL) utilizes a multi-step process to make rocket fuel. In the process, the precursor 2-Hydroxyethylhydrazine (HEH) is pumped into a reactor under a nitrogen purge, set at 0.5° C. The HEH is agitated while deionized water is slowly added to the reactor. The mixture is agitated for 10 minutes to reach a consistent temperature of about 1° C. The mixture is continuously agitated while nitric acid ($HNO_3$) is slowly added. The pH of the mixture is constantly measured throughout the process. The temperature of the mixture is monitored in order to prevent it from increasing above 10° C. The pH range starts at about 8-9 at the beginning of the nitric acid addition, and decreases to about 6-7 near the end of the addition. The addition of nitric acid is slowed, and the reaction is sampled. Enough acid is added to keep the pH in the range of 4.8-5.0. When the HEHN is the correct pH range, the liquid product (light yellow color) is drained out of the bottom of the reactor and into a pre-cleaned container.

The newly synthesized HEHN is transferred into a rotary evaporator where the water is removed and neutralized. This process continues until the overall water percentage of the HEHN reaches 10 percent. Smaller samples can be put back into the rotary evaporator to lower the water content to 3 percent at a later time. The HEHN is sparged with nitrogen to remove remaining water, then removed from the rotary evaporator and put into a storage vessel under nitrogen. A sample of the final product is used for testing. The pH and percentage HEHN and water are checked by potentiometric titration. The target pH is in the range of 4.8-5.0, producing a mixture of about 95 weight percent HEHN with water. The HEHN is kept packaged under $N_2$. The filled vessel is removed and placed in a proper storage location for a D.O.T. 1.3 explosive material.

The multi-step process used by AFRL requires dilution with water to control the nitration rate of HEH to HEHN. The AFRL process is time consuming, requiring multiple steps to achieve a uniform mixture of HEHN with the desired volume percent water. To produce a hypergolic green fuel (HGF), HEHN produced by the AFRL method described above must be mixed with the solvent Acetone, adding an addition process step.

SUMMARY

Embodiments of the present disclosure include one-step synthesis to prepare a hypergolic green Fuel (HGF) propellant from 2-Hydroxyethylhydrazine (HEH) via a "one-step synthesis method". In addition, embodiments of the present disclosure include fully nitrated HGF and partially nitrated HGF and formulations containing Hydroxyethylhydrazinium Nitrate (HEHN) and acetone, where the HEHN is produced independently.

An embodiment of the present disclosure includes a method of preparing hypergolic green fuel (HGF) propellant, among others, that includes: providing a solution of acetone in 2-Hydroxyethylhydrazine (HEH), wherein the solution is about 15 to 50 percent by volume acetone in HEH; and adding nitric acid containing less than 5% water to the acetone-HEH solution to form the HGF propellant, wherein the molar ratio of nitric acid to HEH is less than about 0.05:1 to 1.4:1. Embodiments of the present disclosure also include products from the methods described above.

An embodiment of the present disclosure includes a HGF solution, among others, that includes: HGF solution, comprising HEHN-acetone, wherein the volumetric ratio of acetone to HEHN is about 15 to 50%.

These embodiments, uses of these embodiments, and other uses, features and advantages of the present disclosure, will become more apparent to those of ordinary skill in the relevant art when the following detailed description of the preferred embodiments is read in conjunction with the appended figures.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

FIG. 1.1 is a graph that illustrates the FTIR spectrum of HEHN reported by AFRL.

FIG. 1.2 is a graph that illustrates the FTIR spectrum measured for a pure HEHN sample provided by AFRL.

FIG. 1.3 is a graph that illustrates the FTIR for an embodiment of the Hypergolic green fuel (HGF) containing 50% acetone using an embodiment of a method of the present disclosure.

FIG. 1.4 is a graph that illustrates the FTIR of the precursor HEH and HEHN sample provided by AFRL.

FIG. 1.5 is a graph that illustrates the FTIR of the precursor HEH and HGF as prepared using an embodiment of the present disclosure.

FIG. 1.6 is a graph that illustrates the FTIR of HGF produced using an embodiment of the present disclosure (50 volume % acetone) with 0-4% water.

FIG. 1.7 is a graph that illustrates the FTIR of HGF produced using an embodiment of the present disclosure (25 volume % acetone) with 0-4% water.

FIG. 1.8 is a graph that illustrates the FTIR of HGF produced using an embodiment of the present disclosure (37 volume % acetone) with 0-4% water.

FIG. 1.9 is a graph that illustrates the effect of water on the Chemical Delay Times (CDT) of HGF produced using an embodiment of the present disclosure with 40% acetone.

FIG. 1.10 is a graph that illustrates the effect of water on the CDT of HGF produced using an embodiment of the present disclosure containing 25% acetone and HEHN provided by AFRL with 3 volume % water.

FIG. 1.11 is a graph that illustrates a comparison of the effect of acetone on the CDT of HGF produced using an embodiment of the present disclosure and HGF made by mixing HEHN provided by AFRL and acetone.

FIG. 1.12 illustrates the acetone concentration vs. CDT for partially and fully nitrated fuels.

FIG. 1.13 illustrates a graph of partially nitrated HGF and fully nitrated HGF.

FIG. 2.1 illustrates a graph of the heat resistance versus mass percent of acid added for two solutions.

FIG. 3.1 illustrates a graph of the chemical delay time versus volume percent of acetone for two solutions.

FIG. 3.2 illustrates a graph of temperature versus time for heat release.

FIG. 4.1 illustrates a graph that shows the possibility of pre-added RFNA to adequately heat the fuel before reaction.

FIG. 4.2 illustrates a graph that shows the heat of reaction for RFNA in 0.16/1 solution.

FIG. 4.3 illustrates a graph of the CDT of RFNA added to 0.16/1 solution.

FIG. 4.4 illustrates a graph of temperature versus CDT.

FIG. 4.5 illustrates a graph of temperature versus IDT.

DETAILED DESCRIPTION

Before the present disclosure is described in greater detail, it is to be understood that this disclosure is not limited to particular embodiments described, as such may, of course, vary. It is also to be understood that the terminology used herein is for the purpose of describing particular embodiments only, and is not intended to be limiting, since the scope of the present disclosure will be limited only by the appended claims.

Where a range of values is provided, it is understood that each intervening value, to the tenth of the unit of the lower limit (unless the context clearly dictates otherwise), between the upper and lower limit of that range, and any other stated or intervening value in that stated range, is encompassed within the disclosure. The upper and lower limits of these smaller ranges may independently be included in the smaller ranges and are also encompassed within the disclosure, subject to any specifically excluded limit in the stated range. Where the stated range includes one or both of the limits, ranges excluding either or both of those included limits are also included in the disclosure.

Unless defined otherwise, all technical and scientific terms used herein have the same meaning as commonly understood by one of ordinary skill in the art to which this disclosure belongs. Although any methods and materials similar or equivalent to those described herein can also be used in the practice or testing of the present disclosure, the preferred methods and materials are now described.

All publications and patents cited in this specification are herein incorporated by reference as if each individual publication or patent were specifically and individually indicated to be incorporated by reference and are incorporated herein by reference to disclose and describe the methods and/or materials in connection with which the publications are cited. The citation of any publication is for its disclosure prior to the filing date and should not be construed as an admission that the present disclosure is not entitled to antedate such publication by virtue of prior disclosure. Further, the dates of publication provided could be different from the actual publication dates that may need to be independently confirmed.

As will be apparent to those of skill in the art upon reading this disclosure, each of the individual embodiments described and illustrated herein has discrete components and features which may be readily separated from or combined with the features of any of the other several embodiments without departing from the scope or spirit of the present disclosure. Any recited method can be carried out in the order of events recited or in any other order that is logically possible.

Embodiments of the present disclosure will employ, unless otherwise indicated, techniques of chemistry, materials science, physics, engineering, and the like, which are within the skill of the art. Such techniques are explained fully in the literature.

The following examples are put forth so as to provide those of ordinary skill in the art with a complete disclosure and description of how to perform the methods and use the compositions and compounds disclosed and claimed herein. Efforts have been made to ensure accuracy with respect to numbers (e.g., amounts, temperature, etc.), but some errors and deviations should be accounted for. Unless indicated otherwise, parts are parts by weight, temperature is in ° C., and pressure is at or near atmospheric. Standard temperature and pressure are defined as 20° C. and 1 atmosphere.

Before the embodiments of the present disclosure are described in detail, it is to be understood that, unless otherwise indicated, the present disclosure is not limited to particular materials, reagents, reaction materials, manufacturing processes, or the like, as such can vary. It is also to be understood that the terminology used herein is for purposes of describing particular embodiments only, and is not intended to be limiting. It is also possible in the present disclosure that steps can be executed in different sequence where this is logically possible.

It should be noted that, as used in the specification and the appended claims, the singular forms "a," "an," and "the" include plural referents unless the context clearly dictates otherwise. Thus, for example, reference to "a support" includes a plurality of supports. In this specification and in the claims that follow, reference will be made to a number of terms that shall be defined to have the following meanings unless a contrary intention is apparent.

Discussion

Embodiments of the present disclosure include a one-step synthesis to prepare a hypergolic green Fuel (HGF) propellant from 2-Hydroxyethylhydrazine (HEH) via a "one-step synthesis method". Embodiments of the present disclosure include fully nitrated HGF and partially nitrated HGF. Embodiments of the present disclosure include formulations containing Hydroxyethylhydrazinium Nitrate (HEHN) and acetone, where the HEHN is produced independently. Embodiments of the present disclosure ignite consistently and quicker at elevated temperatures (e.g., at temperatures of about 250 and 350 F), than that prepared using a multi-step method ("AFRL multi-step method"). Embodiments of the present disclosure have successfully been used in open-air ignition tests and engine tests.

In short, an embodiment of the present disclosure involves mixing a solution of HEH (CAS 109-84-2) and acetone prior to nitration with nitric acid (CAS 7697-37-2) (e.g., white fuming nitric acid). In an embodiment, white fuming nitric acid (WFNA) containing less than 5% water can be used in a reduced temperature bath (e.g., at temperatures below about 32° F. (e.g., a set temperature)). An embodiment of the present disclosure further includes a method of preparing HGF rocket fuel comprising providing a solution of acetone in HEH, wherein the solution is about 25 to 50 percent (or about 30 to 45 percent or about 38 percent in other embodiments) acetone by volume in HEH, and adding nitric acid to the acetone-HEH solution to form the HGF, where the molar ratio of nitric acid to HEH is about 0.05:1 to 1.4:1. In another embodiment, the molar ratio of nitric acid to HEH is about 1:1, which can be used to produce the fully nitrated HGF. In another embodiment, the molar ratio of nitric acid to HEH is about 0.13:1 to 0.19:1, which can be used to produce the partially nitrated HGF. In another embodiment, the molar ratio of nitric acid to HEH is about 0.16:1, which can be used to produce the partially nitrated HGF.

An embodiment of the present disclosure includes a solution, comprising HEHN-acetone, where the ratio of HEHN to acetone is about 15 to 50% by volume. An embodiment of the present disclosure also includes a solution, comprising HEHN-acetone, wherein the volume percentage of water is about 3%. Another embodiment of the present disclosure also includes a solution, comprising HEHN-acetone, wherein the volume percentage of water is about 3% and may include other ignition promoters (e.g., long chain alcohols, aldehydes, or ketones, such as n-propanol (e.g., about 5 to 25% or about 10 to 15% (N) n-propanol lowered ignition temperature by about 10%)).

Fourier Transform Infrared (FTIR) spectra of embodiments of the present disclosure were measured to show that the one-step synthesis method produces a superior product in that the analyte peaks are narrower. The broader peaks of the AFRL HEHN and acetone solution indicate the presence of un-reacted HEH (present in the HEHN) and other materials over the multi-step method used by AFRL. In embodiments of the present disclosure, the presence of water in all mixtures of HEHN synthesized with acetone had only minimal effects on the resulting spectra. The volume percentage of water greatly affects the Chemical Delay Times (CDT) of HGF mixtures produced using an embodiment of the present disclosure, but not the FTIR spectra. Therefore, although not being bound by theory, water appears to play a role in the decomposition and ignition mechanism, perhaps due to hydroxyl formation.

The one-step synthesis of HEH-acetone to HGF not only minimized the time, materials, and equipment required to nitrate HEH following the AFRL multi-step method, but also permits jacket temperatures well below freezing, thereby potentially improving safety. The one-step synthesis method produces a more consistent and reactive propellant than the HEHN synthesized by the AFRL multi-step method, which improves the ignition characteristics of hypergolic rocket engines.

The addition of acetone to HEHN and the use of acetone in producing HGF improves the fluid dynamic properties of the mixture-namely reduced viscosity and surface tension. These characteristics (viscosity and surface tension) impact how readily a fluid flows and its miscibility (or ability to easily mix) with other fluids.

Embodiments of the present disclosure include replacing the water used by AFRL in the multi-step method with various amounts of acetone (e.g., about 99.6% acetone). An embodiment of the present disclosure includes solutions of about 25 to 50 percent by volume acetone in HEH. Embodiments of the present disclosure include solutions made so that the total volume of HEH and acetone were small enough to maintain rapid heat removal in the laboratory setting (i.e., approximately 1 ml total volume). In an embodiment, upon mixing of the HEH and acetone, heat of mixing was observed and controlled by keeping the mixture cold (e.g., less that about 32° F. (e.g., a set temperature)). The HEHN provided by AFRL mixed with acetone also showed a heat of mixing consistent with that of HEH mixed with acetone. Both the pure HEH and the solution of HEH plus acetone were tested for hypergolic activity at room temperature using red fuming nitric acid (RFNA), neither of which ignited under this condition. Embodiments of the processes described herein can be readily scaled up to larger volumes (1 L or larger) given sufficient heat removal capabilities as noted below.

Embodiments of the present disclosure include placing the HEH and acetone solutions into individual vials ("reaction vessels"). Embodiments of the present disclosure include providing for a way to remove heat caused by the reaction. Embodiments of the present disclosure include providing a separate vessel in which a salt water ice bath (or other liquid or way to remove heat) is prepared, providing bath temperatures below about 32° F. to be maintained. Embodiments of the present disclosure include placing the reaction vessel into the ice bath (or other liquid or way to remove heat) for about 5 to 10 minutes, and allowing the solution to reach a uniform temperature.

Embodiments of the present disclosure include for each solution of HEH and acetone, nitric acid, in particular, WFNA was added at several molar ratios of WFNA to HEH. Embodiments of the present disclosure include molar ratios of WFNA to HEH ranging from about 0.13:1 to 1.4:1. In an embodiment, the molar ratio is a stoichiometric ratio of 1:1. In an embodiment, the molar ratio is a stoichiometric ratio of 0.16:1. Embodiments of the present disclosure include adding WFNA as received from Sigma Aldrich added drop wise from a syringe to the acetone-HEH mixture to attain the desired molar ratio. Embodiments of the present disclosure include the initial drops of acid raising the solution temperature due to heat of reaction between the extremely concentrated HEH-acetone mixture and locally concentrated WFNA, releasing the typical fume from the acid. As the nitration continues, this effect is diminished.

Embodiments of the present disclosure include allowing the solution to cool to bath temperature prior to adding additional nitric acid. Embodiments of the present disclosure include an initial temperature rise of about 10° F. due to the small sample size and inadequate mixing that can both be resolved during scale-up. Embodiments of the present disclosure include placing the solution under a nitrogen atmosphere and allowing it to equilibrate for several days once all of the nitric acid is added. Embodiments of the present disclosure include the solution changing during this time from a pale yellow to an amber color comparable to the pure HEHN samples provided by AFRL. It should be noted that the method includes controlling the addition of nitric acid to form HGF that can be partially nitrated or fully nitrated.

Embodiments of the present disclosure including the single step synthesis method of producing HGF not only minimizes the time, materials and equipment required to nitrate HEH following the AFRL multi-step method, but also permits jacket temperatures well below freezing, thereby potentially improving safety. Embodiments of the present disclosure include a one-step synthesis method that produces a more consistent and reactive propellant, as will be discussed in the following examples. It should be noted that the methods described herein can be scaled up (e.g., volumes of components, etc.) to produce larger volumes of HGF.

Partially nitrated HGF can be made using a similar procedure as described with fully nitrated HGF, but the acid concentration can be varied from about 0.01% to 75%, 5 to 35%, or about 5 to 25%. In an embodiment, the partially nitrated HGF can comprise a volume concentration of 25% (+/−5%) acetone with 10.5% (+/−5%) volume of nitric acid (WFNA). In an embodiment, the partially nitrated HGF can comprise a volume concentration of 25% (+/−10%) acetone with 10.5% (+/−10%) volume of nitric acid (WFNA). In an embodiment, the partially nitrated HGF can comprise a volume concentration of 25% (+/−15%) acetone with 10.5% (+/−15%) volume of nitric acid (WFNA). In an embodiment, the partially nitrated HGF can comprise a volume concentration of 25% (+/−20%) acetone with 10.5% (+/−20%) volume of nitric acid (WFNA). In an embodiment, the partially nitrated HGF can comprise a volume concentration of 25% (+/−25%) acetone with 10.5% (+/−25%) volume of nitric acid (WFNA). In an embodiment, the partially nitrated HGF can comprise a volume concentration of 25% (+/−35%) acetone with 10.5% (+/−35%) volume of nitric acid (WFNA). In an embodiment, the partially nitrated HGF can comprise a volume concentration of 25% (+/−45%) acetone with 10.5% (+/−45%) volume of nitric acid (WFNA). In an embodiment, the partially nitrated HGF can comprise a volume concentration of 25% (+/−55%) acetone with 10.5% (+/−55%) volume of nitric acid (WFNA).

It should be noted that ratios, concentrations, amounts, and other numerical data may be expressed herein in a range format. It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a concentration range of "about 0.1% to 5%" should be interpreted to include not only the explicitly recited concentration of about 0.1 wt % to about 5 wt %, but also include individual concentrations (e.g., 1%, 2%, 3%, and 4%) and the sub-ranges (e.g., 0.5%, 1.1%, 2.2%, 3.3%, and 4.4%) within the indicated range. The term "about" can include ±1%, ±2%, ±3%, ±4%, ±5%, ±6%, ±7%, ±8%, ±9%, or ±10%, or more of the numerical value(s) being modified. In addition, the phrase "about 'x' to 'y'" includes "about 'x' to about 'y'".

It should be emphasized that the above-described embodiments of the present disclosure are merely possible examples of implementations, and are merely set forth for a clear understanding of the principles of this disclosure. Many variations and modifications may be made to the above-described embodiment(s) of the disclosure without departing substantially from the spirit and principles of the disclosure. All such modifications and variations are intended to be included herein within the scope of this disclosure and protected by the following claims.

Now having described the embodiments of hypergolic green fuel and methods of making hypergolic green fuel, in general, the examples describe some additional embodiments of the present disclosure. While embodiments of present disclosure are described in connection with the examples and the corresponding text and figures, there is no intent to limit embodiments of the present disclosure to this description. On the contrary, the intent is to cover all alternatives, modifications, and equivalents included within the spirit and scope of embodiments of the present disclosure.

EXAMPLES

Example 1

The Chemical Delay Times (CDT) for HEHN reacted with RFNA and various solvents and catalysts have been researched. The HEHN which was synthesized by the AFRL ("AFRL-HEHN") is briefly described below. In short, the process used by AFRL requires the use of WFNA diluted with water to control the nitration rate of HEH to HEHN. Excess water is removed from HEHN after the synthesis reaction, using a rotary evaporator. The AFRL process is time consuming requiring multiple steps to achieve a uniform mixture of HEHN and 3 percent water. The final HEHN material is a viscous liquid difficult to use as a propellant without modification.

Various solvents were used to reduce surface tension and viscous effects, but acetone produced the most favorable hypergolic results when reacted with RFNA containing nickel nitrate in the range of 1-3 mole percent, typically 2.2 mole percent. Heat of mixing was observed with several solvents including acetone when added to HEHN. CDT measurements of this fuel mixed with from 15 to 50 volume percent acetone produced a hypergolic response when heated above 250° F.

This example describes a one-step synthesis method to produce HGF from a mixture of HEH and acetone. FTIR measurements of HGF made with AFRL synthesized HEHN are compared to the HGF produced using this one-step synthesis method. In general, the one-step synthesis method fuel produces a more uniform spectrum than the fuel produced by the existing AFRL multi-step method. These results are presented and discussed in a following section.

In addition, embodiments of the procedure can be used to produce partially nitrated HGF or fully nitrated HGF. The fully nitrated HGF is described above and elsewhere in the disclosure. Partially nitrated HGF can be made using a similar procedure as described with fully nitrated HGF, but the acid concentration can be varied from about 0 to 75%, 5 to 35%, or about 5 to 25%.

CDT measurements of the one-step synthesis method fuel containing 15 to 50 volume percent acetone with 0-4 volume percent water produced more rapid hypergolic response then the AFRL multi-step method fuel when heated above 250° F. Supporting CDT results are included later in this disclosure.

FTIR Comparative Analysis of HEH and HEHN

FTIR spectroscopy was used to compare the HGF synthesized using embodiments of the present disclosure to that made with HEHN supplied by AFRL. The FTIR of HEH, HEHN and the various HGF solutions were obtained using a NEXUS 470 FTIR spectrometer using the average of 32 scans collected over 39 seconds. For this spectroscopic analysis, Potassium Bromide (KBr) real crystal IR sample cards were used. The various mixtures and pure components were added to the IR card in the form of droplets. In order to determine the right amount of solution to apply to the IR card, a variety of spectra with different drop sizes were collected. The best results were obtained using a 5 μL drop, which was then held constant throughout the study. The drop was added to the center of the crystal card using a 10 μL syringe and was distributed across the face of the card using the tip of the needle to produce consistent results.

Since IR cards have variations, a procedure was developed to reference each spectrum to its specific IR card. Each new card was placed in the spectrometer and a reference spectrum collected. To this card, a 5 μL drop was applied, and the actual spectrum collected and normalized to its reference spectrum. Typically this process was accomplished 2-3 times to establish consistent results for each mixture or pure component studied.

Initially, the relative FTIR spectrums of samples of HEHN as received from AFRL with a spectrum generated at AFRL were compared not only to verify the experimental technique, but also to determine peak locations for further analysis. It should be noted that the experimental techniques used by AFRL can influence the overall resolution relative to that collected with the present instrument.

FIGS. 1.1 and 1.2 present the HEHN spectra measured by AFRL and that collected at UAH, respectively. In FIG. 1.2, the left side of the spectrum has a higher absorbance than the spectrum provided by the AFRL. Although the two spectra look similar below 2000 nm, the peaks in both spectra align. Since FIG. 1.2 utilized the actual sample provided by AFRL, it was used to calibrate the peak locations for the spectroscopic analysis.

Next, a sample of the HEHN provided by AFRL with 50 volume percent acetone was measured in the UAH provided FTIR spectrophotometer. A direct comparison between HGF made from the HEHN provided by AFRL and HGF synthesized using embodiments of the present disclosure, both containing 50 volume percent acetone were measured. For comparison purposes these two spectra were overlaid to produce a single spectrum as can be seen in FIG. 1.3.

FIG. 1.3 clearly shows that the HGF synthesized using embodiments of the present disclosure (in bold) has the same peak structure as HGF using HEHN provided by AFRL. It can be seen that HGF synthesized using embodiments of the present disclosure does not have as much peak broadening, especially around the main peak at 1394. The peak at 1394 on the HEHN provided by AFRL shows peak broadening, which indicates the presence of incomplete reaction, side reactions or impurities. To explore the possibility of incomplete nitration of HEH, a series of experiments were conducted using the HEH precursor.

FIGS. 1.4 and 1.5 present overlaid spectra of the pure HEH precursor to that of HEHN provided by AFRL and the HGF synthesized using embodiments of the present disclosure. The double peak of the HEH spectrum changes to a single peak with a larger intensity. The single peak characteristic can be seen in both FIGS. 1.4 and 1.5.

In both FIGS. 1.4 and 1.5 it can be seen that the main spectrum line of HEHN provided by AFRL at 1394 is not only broader, but has a shoulder on the lower wave number side of the peak. Careful examination of FIGS. 1.4 and 1.5, indicate other differences in the spectra, namely peak shape and baseline absorption differences. The HEHN provided by AFRL appears to have residual HEH remaining in the fuel and, therefore, has an incomplete nitration reaction.

One difference between the HGF synthesized using embodiments of the present disclosure and the HGF made from HEHN provided by AFRL is that the AFRL fuel still contains 3-10 volume percent water. A feasibility study was conducted to assess the role that water played when added to HGF synthesized using embodiments of the present disclosure. Water was added at varying percentages from 0-4 volume percent, and the FTIR spectrum determined at each concentration.

FIG. 1.6 shows FTIR spectra of HGF synthesized using embodiments of the present disclosure with 50 volume percent acetone with 0-4 volume percent water. The figure shows the different percentages of water in the following order from top to bottom: 0, 4, 3, and 2 volume percent water. In FIG. 1.6, the water content only affected the attenuation of the FTIR spectra and not the peak locations. The same effect can be seen for HGF containing 25 volume percent acetone (FIG. 1.7) and 37 volume percent acetone (FIG. 1.8).

FIG. 1.7 shows the different percentages of water in the following order from top to bottom: 0, 2, 1, and 3 volume percent water. The order of the different spectra in FIG. 1.8 is the same as FIG. 1.7.

In conclusion to this section, FIG. 1.3 clearly shows that the one-step synthesis method developed produces a superior product over the multi-step method utilized by AFRL. The presence of water in HGF solutions synthesized using embodiments of the present disclosure containing various amounts of acetone has only minimal effects on the resulting spectra. There is a slight attenuation to the peaks around 3300 wave numbers and a slight broadening of the 1394 wave number. This slight broadening may help to explain part of the broadening seen in the HEHN spectrum provided by AFRL.

CDT Analysis of HEHN

Since it was determined that water did not have any effect on the peak locations or structure in the FTIR spectra of HGF, a series of studies on the effects of water on the CDT of HGF synthesized using embodiments of the present disclosure compared with the HGF made from HEHN provided by AFRL were conducted. To measure and compare the CDT data for both the HGF synthesized using embodiments of the present disclosure and HGF made from HEHN provided by AFRL with acetone addition, the reactor was heated to 300° F. and the solution reacted with catalyzed red fuming nitric acid (CRFNA). The CDT's for both fuels were measured using a laser diagnostics technique developed at UAH and detailed in Dasarathy, R. and Smith, Jr., J. E. "Kinetic Studies Using Chemical Delay Times of Anhydrous Hydrazine and Other Hypergolic Fuels," A Thesis, 2006.

The CDT's were studied over the range of 15-50 volume percent acetone in HEH. A mass balance was performed to determine the volume percent acetone in HEHN after the nitration reaction reached equilibrium. The HGF synthesized using embodiments of the present disclosure was found to have acetone volume percentages ranging from 18.8-40.9 volume percent, which were compared to the HGF made from HEHN provided by AFRL mixtures ranging from 15 to 50 volume percent acetone. This resulted from a decrease in volume from the nitration reaction. For example, a solution of 33 volume percent acetone in HEH was required to synthesize a HGF containing 25 volume percent acetone.

The HGF solutions synthesized using embodiments of the present disclosure containing varying percentages of water were tested for the effect of water on the CDT's. FIG. 1.9 shows the effect of water on the CDT of HGF synthesized using embodiments of the present disclosure with 40 volume percent acetone. In FIG. 1.9, the addition of water slightly decreased the CDT of HGF synthesized using embodiments of the present disclosure/RFNA until a concentration of over 2 volume percent was achieved. The addition of water slowly decreased the CDT of HGF to about 12.6 milliseconds when a concentration of 3 volume percent water was reached. If the concentration of water exceeded 3 volume percent, then the CDT quickly increased to a value of 35 milliseconds at a concentration of 4 volume percent for a CDT increase of 170 percent. The effect of water below or above 3 volume percent for HGF made from HEHN provided by AFRL was not determined due to the nature of the fuel's multi-step synthesis. It may well be that 3 volume percent water in the pure HEHN provided by AFRL represents a singularity point when trying to further extract water by rotary evaporation. However, the comparison between HGF synthesized using embodiments of the present disclosure and HGF made from HEHN provided by AFRL at 3 volume percent water can be compared. Referring to FIG. 1.9 at 3 volume percent water, the HGF synthesized using embodiments of the present disclosure had a CDT of 12.6 ms+/−1.38 ms and the HGF made from HEHN provided by AFRL at 16.25 ms+/−1.73 ms for a relative error of 29%. Water was also added to the HEHN provided by AFRL, resulting in an increase in the CDT. The values are not reported in FIG. 1.9 due to inconsistencies in the results.

The effects of water on the CDT's of HGF synthesized using embodiments of the present disclosure with 25 volume percent acetone were also explored. The results for this series of tests are shown in FIG. 1.10. The volume percent water decreased the CDT of HGF synthesized using embodiments of the present disclosure with 25% acetone more dynamically than HGF synthesized using embodiments of the present disclosure with 40% acetone. The addition of 1 volume percent water to HGF synthesized using embodiments of the present disclosure with 25% acetone decreased the CDT from 4.9 ms to 3.5 ms. This trend continues until a minimum CDT value of 2.3 ms was achieved at 3 volume percent water. The comparison of CDT values for HGF synthesized using embodiments of the present disclosure and that of HGF made from HEHN provided by AFRL are compared graphically in FIG. 1.10. It was determined that the HGF synthesized using embodiments of the present disclosure had a CDT of 2.3 ms+/−0.21 ms compared to the HGF made with HEHN provided by AFRL at 3.8 ms+/−0.75 ms for a relative error of 65%. Not only was the HGF synthesized using embodiments of the present disclosure faster, it also had a more consistent ignition than the HGF made from HEHN provided by AFRL under identical conditions. Consistency of results is important to combustion instability during the ignition of hypergolic engines.

FIGS. 1.9 and 1.10 both show that the optimum volume percentage of water in the HGF was achieved at 3 volume percent water. Solutions of HGF synthesized using embodiments of the present disclosure and HGF made from HEHN provided by AFRL with 3 volume percent water were tested at varying volume percent acetone to determine the effect on the CDT values. The results of the study can be seen in FIG. 1.11. The CDT values for HGF synthesized using embodiments of the present disclosure and HGF made from HEHN provided by AFRL both increase as the volume percent of acetone is increased until a minimum value is reached at 25 volume percent acetone. The CDT values for the HGF synthesized using embodiments of the present disclosure mirrors the data for HGF made from HEHN provided by AFRL.

From the data in FIGS. 1.10 and 1.11, it can be seen that the standard error for the HGF synthesized using embodiments of the present disclosure is far less than that of the HGF made from HEHN provided by AFRL. The difference in the error can be attributed to the consistency in which the fuel ignites upon contact with the acid. The HGF made from HEHN provided by AFRL does not ignite as consistently as the HGF synthesized using embodiments of the present disclosure, which again is important for consistent engine ignition.

In both FIGS. 1.9 and 1.10 it can be seen that the error associated with the mean values decreases to a minimum at a value of 3 volume percent water. The volume percentage of water greatly affects the CDT's of both 25 and 40 volume percent acetone in HGF synthesized using embodiments of the present disclosure and not the FTIR spectra. Therefore, water plays a role in the decomposition and ignition mechanism, perhaps due to hydroxyl formation.

CONCLUSION

The research conducted has lead to the development of a new one-step synthesis method to prepare hypergollic green fuel (HGF). The one-step synthesis not only minimized the time, materials and equipment required to nitrate HEH following the AFRL multi-step method, but also permits jacket temperatures well below freezing, thereby potentially improving safety.

FTIR spectroscopy was used to compare the one-step synthesis of HGF to that prepared by mixing acetone with HEHN produced by AFRL. The FTIR analysis shows that the one-step synthesis method produced a superior product over the multi-step method utilized by AFRL. The presence of water in all mixtures of HGF synthesized at UAH with acetone and water additions has only minimal effects on the resulting spectra. There is a slight attenuation to the peaks around 3300 wave numbers and a slight broadening of the 1394 wave number peak. This slight broadening may help to explain part of the broadening seen in the HEHN provided by AFRL spectrum.

The one step synthesis method does not make use of water during the nitration reaction of the HEH-acetone mixture. This permitted a study of the effect of water on the ignition and combustion of HGF synthesized using embodiments of the present disclosure. It was determined that there is an optimum volume percentage of water that produced a faster igniting and more consistent burning propellant than that of the HGF produced by mixing acetone with HEHN made using the AFRL multi-step method. The volume percentage of water greatly affects the CDT's of both 25 and 40 volume percent acetone in HGF synthesized using embodiments of the present disclosure but not the FTIR spectra. Therefore, water plays a role in the decomposition and ignition mechanism, perhaps due to hydroxyl formation. HGF made with HEHN provided by AFRL does not ignite as consistently or as fast as the HGF synthesized using embodiments of the present disclosure, which again is important for consistent rocket engine ignition.

FIG. 1.12 illustrates the acetone concentration vs. CDT for partially and fully nitrated fuels. It was discovered that while the CDTs are similar, the Liquid Reaction Time (LRT) for the partially nitrated fuel is much faster The original fuel has a LRT of 1.1 s while the partially nitrated formula has a LRT of 0.2 s. Also, the partially nitrated fuel functions at much lower temperatures, with ignition occurring at temperatures as low as 225° F. For each fuel variation, the amount of acid added to the fuel was varied with O/F ratios from 1:4 to 3:1. The nominal O/F ratio was found to be at 2:1.

FIG. 1.13 illustrates a graph of partially nitrated HGF and fully nitrated HGF.

Example 2

We performed an experiment to find the heat of reaction by measuring temperature rise from ambient temperature after each drop of acid into a 1 mL HEH/Acetone solution, allowing the solution to cool after each added drop. When measuring the heat of reaction, we noticed several spikes in temperature as we added acid. FIG. 2.1 shows the first spike in heat release which occurs at 17% mass of acid. This concentration was the focus of experiments performed to determine the efficiency of the fuel mixtures made with less acid. An error in the data acquisition system resulted in an error of +/−2 F.

A mixture of 33 volume % Acetone and 66 volume % HEH was reacted with WFNA in accordance with the heat of reaction graph. Approximately 0.120 milliliters (or 17.7 microliter drops) of WFNA was added to a 1 ml solution of the above composition, which produced the fuel at the bottom of the first curve in the heat of reaction chart. The new fuel was tested for CDT data by reaction with 2.2 mole % $NiNO_3$/RFNA at 300 F. The fuel was difficult to ignite and produced CDT data that was inconsistent with previous formulations. A mixture of 25 volume % Acetone and 75 volume % HEH was reacted with WFNA in accordance with the heat of reaction graph. Approximately 0.120 micro liters (or 17.7 microliter drops) of WFNA was added to a 1 ml solution of the above composition. The new fuel was tested for CDT data by reaction with 2.2 mole % $NiNO_3$/RFNA at 300 F. The new fuel produced CDT data that was consistent with the previous formulations. In addition to consistently producing similar CDT data, the new fuel's Ignition Delay Time was substantially reduced from the previous formulation. We also attempted to produce the same 25 volume % Acetone and 75 volume % HEH fuel by using RFNA. During the reaction, the solution over reached our temperature boundaries, i.e., acted as though the fuel was going to ignite. Due to the red color of RFNA, the resulting solution maintained a darker color than the same fuel produced with WFNA. In order to use the same amount of RFNA as WFNA for 20% of the RFNA was assumed to be $N_2O_4$ and additional acid was added to compensate. The RFNA fuel was tested with the same $NiNO_3$/RFNA and did not produce any CDT data due to failing to ignite.

Example 3

We continued experimentation with varying the composition of acid and acetone in the fuel solution. We made solutions containing various concentrations of acetone, adding acid in a ratio to 0.16/1 acid/HEH. CDT measurements were taken at 300 F for each solution made. The results showed CDTs that were similar to the CDTs for the equimolar solution of acid and HEH. However, unlike previous fuel solutions, these results could be obtained without the addition of a catalyst to the acid.

From the graph (FIG. 3.1), it can be seen for the new solution that the CDT changes very little at lower concentrations of acetone, with measurements faster than those of equimolar mixtures at similar concentrations of acetone. The fastest CDT measurements appear close to 25% volume which is consistent with previous measurements for equimolar solutions. At concentrations higher than 25%, the new solution becomes less reactive and consistent, and the CDT increases much more sharply than with the equimolar solution.

Although the CDTs are similar for the two solutions, the liquid reaction time (LRT) was greatly decreased. The liquid reaction time of the 0.16 formulation is much less than that of the equimolar fuel, improving from an average of 1.1 s in equimolar fuel to an average of 0.2 s in the new solutions. It was observed that in both solutions the LRT changed very little as a function of acetone concentration.

Attempts were made to measure the heat released from the addition of acid to the 0.16 mol solution in an attempt to study the large peak that was observed in previous heat of reaction experiments. This was done by measuring the heat generated my adding RFNA up to the equimolar level all at once. The results indicate a spike in temperature to up to 250 F before leveling off at around 180 F and slowly cooling.

FIG. 3.2 illustrates the sudden rise in temperature upon mixing. Due to the large heat rise upon mixing acid with the new fuel formulation, CDT experiments were attempted at lower temperatures; however there was less activity at temperatures other than 300 F.

Because of the large heat generation, experiments were performed to study the possible use of a pre-addition of RFNA to the process. Experiments were performed using RFNA in the production reaction in the place of WFNA, and the results did not exhibit consistent ignition and showed slower times than the WFNA solutions. Experiments were also done to test a pre-addition of RFNA to the sample by performing the CDT experiment immediately after the mixing of acid. These solutions did not exhibit consistent ignition.

Example 4

The heat of reaction experiments were continued with a more sensitive E type thermocouple. The results of these reactions were varied, primarily because the thermocouple was very thin making it difficult to obtain a consistent position within the reaction vessel. Some of the results obtained with this process did reach over 300 F as seen in FIG. 4.1.

Further experimentation was done with premixing the RFNA with the new fuel formulation with 0.16% WFNA. Although initial experimentation showed little hypergolic activity, further testing was done to obtain measurements of the CDT and IDT when they could be found. Because the exact amount of $N_2O_4$ dissolved in RFNA was unknown due to the range listed as 12-24% and gradual losses due to the age of the RFNA, the volume was varied from 0.35 to 0.46 mL of RFNA per 1 mL of the HEH/acetone formulation to account for 0-24% $N_2O_4$. Hypergolic activity occurred very rarely, and the results were much slower than previous data using the 0.16/1 mixture with CDTs of 227 ms and IDTs of 1.4 seconds. No appreciable difference resulted in varying the amount of RFNA added in these high concentrations.

Testing was then done to explore the effect of smaller amounts of RFNA added to the 0.16 solution. In order to find a RFNA concentration to explore, a heat of reaction experiment similar to the previous test of adding WFNA to the HEH/Acetone solution. In this experiment RFNA was added to the solution containing 0.16% WFNA to the equimolar concentration (assuming a 12% $N_2O_4$ solution), and the results are similar with several peaks along the chart (FIG. 4.2). The biggest peak is at 0.45 mol acid to mol HEH, therefore experiments were conducted around this peak at 0.37 and 0.53 molar ratios.

The results indicate a correlation between amount of RFNA added and the CDT, increasing from the solution of 0.25 ratio of the 0.16/1 solution as seen in FIG. 4.3.

The increase did not exhibit higher CDTs at the molar ratio of 0.45/1 where the high heat release was observed. However the solutions with lower concentrations of RFNA exhibited lower CDTs than those with high concentrations of RFNA. It was also discovered that at these lower RFNA concentrations the IDTs varied at an average of 220 ms.

A plan was developed to examine the possibility of lower temperatures. However, solutions containing RFNA exhibited hypergolic activity at temperatures lower than 300 F. The 0.16/1 solution was tested at varying temperatures, and did exhibit hypergolic behavior at a temperature as low as 225 F. Temperatures were varied from 225 to 325 F and CDTs were recorded as seen in FIG. 4.4.

The CDTs increased as temperatures decreased. With this experiment and the RFNA concentration variation, the error increased with increasing CDT. The trend is linear until the max at 225 when hypergolic behavior is no longer seen, but when observing the IDT of the formula at different temperatures, the IDT increases in an exponential fashion, as seen in FIG. 4.5. This increase shows the lower performance of the fuel mixture at lower temperatures with the liquid reaction time increasing more than CDT.

What is claimed is:

1. A method of preparing hypergolic green fuel (HGF) propellant comprising:

providing a solution of acetone in 2-Hydroxyethylhydrazine (HEH), wherein the solution is about 15 to 50 percent by volume acetone in HEH; and adding nitric acid containing less than 5% water to the acetone-HEH solution to form the HGF propellant, wherein the molar ratio of nitric acid to HEH is less than about 0.05:1 to 1.4:1.

2. The method of claim 1, wherein the acetone-HEH solution is allowed to cool to a set temperature periodically while adding the nitric acid.

3. The method of claim 1, wherein the molar ratio of nitric acid to HEH is less than about 1:1 to 1.4:1.

4. The method of claim 1, wherein the molar ratio of nitric acid to HEH is about 1:1.

5. The method of claim 1, wherein the molar ratio of nitric acid to HEH is about 0.16:1.

6. The method of claim 1, wherein the acetone-HEH solution is cooled so as to remove heat produced during the addition of nitric acid.

7. The method of claim 1, further comprising adding a second ignition promoter.

8. A product produced from any one of claims 1 to 7.

9. A HGF solution, comprising HEHN-acetone, wherein the volumetric percentage of acetone in HEHN is about 15 to 50%, and wherein the volumetric percentage of water is about 0 to 4%.

10. The HGF solution of claim 9, wherein the HGF is partially nitrated HGF.

11. The HGF solution of claim 9, wherein the HGF is fully nitrated HGF.

12. The HGF solution of claim 9, further comprising a second ignition promoter.

13. The HGF solution of claim 9, wherein the volumetric percentage of water is about 3%.

14. The HGF solution of claim 9, wherein the volumetric percentage of water is about 2%.

15. The HGF solution of claim 9, wherein the volumetric percentage of water is about 1%.

16. The method of claim 1, wherein the solution is about 3 percent by volume water.

17. The method of claim 1, wherein the solution is about 2 percent by volume water.

18. The method of claim 1, wherein the solution is about 1 percent by volume water.

* * * * *